US010727006B2

(12) United States Patent
Olmsted et al.

(10) Patent No.: US 10,727,006 B2
(45) **Date of Patent: *Jul. 28, 2020**

(54) SILVER METAL OXIDE ALLOY AND METHOD OF MAKING

(71) Applicant: HONEYWELL INTERNATIONAL INC., Morris Plains, NJ (US)

(72) Inventors: Brian Keith Olmsted, Richfield, MN (US); Jeffrey Hall, Winnebago, IL (US); Darryl Ballard, Barnardsville, NC (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/268,945

(22) Filed: Feb. 6, 2019

(65) Prior Publication Data

US 2019/0172658 A1 Jun. 6, 2019

Related U.S. Application Data

(63) Continuation of application No. 15/274,261, filed on Sep. 23, 2016, now Pat. No. 10,290,434.

(51) Int. Cl.
*H01H 1/04* (2006.01)
*C22C 5/06* (2006.01)
(Continued)

(52) U.S. Cl.
CPC ..... *H01H 1/04* (2013.01); *B22F 1/02* (2013.01); *B22F 1/025* (2013.01); *C22C 1/101* (2013.01);
(Continued)

(58) Field of Classification Search
CPC ..... B22F 2998/10; B22F 3/1055; B22F 2999/00; B22F 1/0003; B22F 3/02; B22F 9/04; H01H 1/023; H01H 13/785; H01H 1/02; H01H 1/021; H01H 13/702; H01H 1/027; H01H 2201/03; H01H 11/045; H01H 1/025; H01H 1/04; H01H 11/041; H01H 1/0206
(Continued)

(56) References Cited

U.S. PATENT DOCUMENTS 4,082,928 A 4/1978 Andersen
4,294,616 A 10/1981 Kim et al.
(Continued)

FOREIGN PATENT DOCUMENTS

CN 1137068 A 12/1996
CN 1425782 A 6/2003
(Continued)

OTHER PUBLICATIONS

Chinese office action for Application No. 201710865384.7, dated Aug. 30, 2019.
(Continued)

*Primary Examiner* — Ahmed M Saeed
(74) *Attorney, Agent, or Firm* — Alston & Bird LLP

(57) ABSTRACT

Various embodiments disclosed relate to an alloy. The alloy includes elemental silver. The alloy further includes a metal oxide phase in the elemental silver. The metal oxide phase includes a wetting agent layer that coats the metal oxide phase.

20 Claims, 1 Drawing Sheet

(51) Int. Cl.

| | |
|---|---|
| ***C22C 1/10*** | (2006.01) |
| ***C22C 32/00*** | (2006.01) |
| ***B22F 1/02*** | (2006.01) |
| *H01H 1/021* | (2006.01) |
| *H01H 1/023* | (2006.01) |
| *H01H 1/0237* | (2006.01) |

(52) U.S. Cl.
CPC ..... *C22C 1/1084* (2013.01); *C22C 5/06* (2013.01); *C22C 32/0021* (2013.01); *H01H 1/021* (2013.01); *H01H 1/023* (2013.01); *H01H 1/0237* (2013.01)

(58) Field of Classification Search
USPC ..... 200/341–345, 267–269, 514, 512, 5 A; 75/234, 235, 232, 233, 244, 247, 252, 75/950; 148/431, 248, 276, 281, 430, 148/513; 419/21, 22, 31, 35, 38, 41, 53, 419/54; 252/514
See application file for complete search history.

(56) References Cited

U.S. PATENT DOCUMENTS

| | | | |
|---|---|---|---|
| 5,497,133 | A | 3/1996 | Dawson et al. |
| 5,798,468 | A | 8/1998 | Weise et al. |
| 5,822,674 | A | 10/1998 | Behrens et al. |
| 10,290,434 | B2 * | 5/2019 | Olmsted ..... H01H 1/04 |
| 2015/0060741 | A1 | 3/2015 | Bender |
| 2016/0172140 | A1 | 6/2016 | Eismann et al. |
| 2018/0090284 | A1 | 3/2018 | Olmsted et al. |

FOREIGN PATENT DOCUMENTS

| | | | |
|---|---|---|---|
| CN | 1635172 | A | 7/2005 |
| CN | 101798641 | A | 8/2010 |
| CN | 102031438 | A | 4/2011 |
| CN | 102864365 | A | 1/2013 |
| CN | 103745842 | A | 4/2014 |
| CN | 104245976 | A | 12/2014 |
| CN | 105702485 | A | 6/2016 |
| CN | 107868880 | A | 4/2018 |
| EP | 0369282 | A2 | 5/1990 |

OTHER PUBLICATIONS

Schoepf, Thomas J., et al, "Development of Silver Zinc Oxide for General-Purpose Relays", IEEE Transactions on Components and Packaging Technologies, 25(4), (Dec. 2002), 656-662.

Office Action for corresponding Chinese Application No. 201710865384.7 dated Dec. 12, 2018.

Mutzel, Timo, et al., "Advanced Silver-Tinoxide Contact Materials for Relay Application", 26th International Conference on Electrical Contacts (ICEC 2012), (2012), 6 pgs.

Jeannot, Didier, et al., "Physical and Chemical Properties of Metal Oxide Additions to Ag—SnO2 Contact Materials and Predictions of Electrical Performance", IEEE. Transactions on Components, Packaging, and Manufacturing Technology—Part A, 17(1), (Mar. 1994), 17-23.

Jeannot, Didier, et al, "The Effects of Metal Oxide Additions or Dopants on the Electrical Performance of AgSnO2", IEEE, (1993), 51-59.

Bernauer, Christian, et al., "Substitution of Silver/Cadmium Oxide in High Voltage Disconnectors", Proceedings of the Fifty-First IEEE Holm Conference on Electrical Contacts, (2005), 42-47.

U.S. Appl. No. 15/274,261, filed Sep. 23, 2016, 2018-0090284 A1, Pending.

Chinese Office Action for Application No. 201710865384.7, dated Mar. 4, 2020, 11 pages.

* cited by examiner

SILVER METAL OXIDE ALLOY AND METHOD OF MAKING

CROSS-REFERENCE TO RELATED APPLICATIONS

This application is a continuation of U.S. application Ser. No. 15/274,261, filed Sep. 23, 2016, the entire contents of which are incorporated herein by reference.

BACKGROUND

Electrical switches are provided with contact materials that facilitate the travel of current through the switch. The contact materials are can be made of a metal alloy. Alloys used in switches designed to carry large currents (>15 amps) are can be fabricated by powder metallurgy or internal oxidation processes. Consequently, these materials include a heterogeneous mixture of alloy constituents. As the switch is cycled between numerous make/break cycles the surface of the contact materials are subjected to momentary periods of extreme heat, causing the surface of the contact to melt, briefly, and then re-solidify. For many alloys used as switch contact materials, the brief period of melting causes the constituents comprising the alloy to undergo a small amount of phase separation because the molten silver does not favorably wet, the surface of the metal oxide. Gradually, the switch contact surface takes on a lamellar composition characterized by silver-rich layers and metal oxide-rich layers. Ultimately, the metal oxide-rich layers lead to high resistivity and switch failure.

SUMMARY

According to one embodiment of the present invention, an alloy includes elemental silver. The alloy further includes a metal oxide phase in the elemental silver. The metal oxide phase includes a wetting agent layer that coats the metal oxide phase.

According to further embodiments of the present invention, a method of making an alloy includes coating a metal oxide phase with a wetting agent to form a coated metal oxide phase. The method further includes compacting the coated metal oxide phase with elemental silver.

According to further embodiments of the present invention, a switch includes a first stationary contact carrier. The switch also includes a first contact pad attached to the first stationary contact carrier and includes a first alloy. The switch further includes a movable contact carrier. A second contact pad is attached the movable contact carrier. The second contact pad includes a second alloy. The second alloy includes elemental silver. The second alloy further includes a metal oxide phase in the elemental silver. The metal oxide phase includes a wetting agent layer that coats the metal oxide phase. The second contact pad is configured to selectively engage the first contact pad.

According to a further embodiment of the present invention, a method of making a switch includes attaching a first contact pad including a first alloy to a first stationary contact carrier. The method further includes attaching a second contact pad to a movable carrier. The second contact pad includes a second alloy. The second alloy includes elemental silver. The second alloy further includes a metal oxide phase in the elemental silver. The metal oxide phase includes a wetting agent layer that coats the metal oxide phase.

In some embodiments of the present invention certain advantages are present, some of which are unexpected. In various embodiments of the present invention the alloy can have substantially equivalent or improved performance and longevity in a switch compared to a switch using a silver cadmium oxide alloy. Additionally, in some embodiments of the present invention, the wetting agent layer can help to reduce the degree of phase separation between the metal oxide phase and the elemental silver as the alloy is subjected to multiple make/break cycles of the switch. In particular, in some embodiments of the present invention, the degree of phase separation is greatly reduced compared to other alloys of elemental silver and a metal oxide phase that use a wetting agent dopant that is not coated on the metal oxide phase. In some embodiments the wetting agent layer forms an interface between the metal oxide phase and the elemental silver such that the elemental silver and metal oxide phase do not directly contact each other, but remain homogeneously dispersed by virtue of the engineered wetting agent interface. This can help to prevent the elemental silver and the metal oxide phase from forming silver-rich regions and metal oxide-rich regions due to constituent aggregation/agglomeration, which is driven by the behavior of molten silver during arc flash of make/break events.

BRIEF DESCRIPTION OF THE FIGURES

In the drawings, which are not necessarily drawn to scale, like numerals describe substantially similar components throughout the several views. Like numerals having different letter suffixes represent different instances of substantially similar components. The drawings illustrate generally, by way of example, but not by way of limitation, various embodiments discussed in the present document.

DETAILED DESCRIPTION

Reference will now be made in detail to certain embodiments of the disclosed subject matter, examples of which are illustrated in part in the accompanying drawings. While the disclosed subject matter will be described in conjunction with the enumerated claims, it will be understood that the exemplified subject matter is not intended to limit the claims to the disclosed subject matter.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section.

In the methods described herein, the acts can be carried out in any order without departing from the principles of the invention, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range, and includes the exact stated value or range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%.

Alloy

Figure 1:
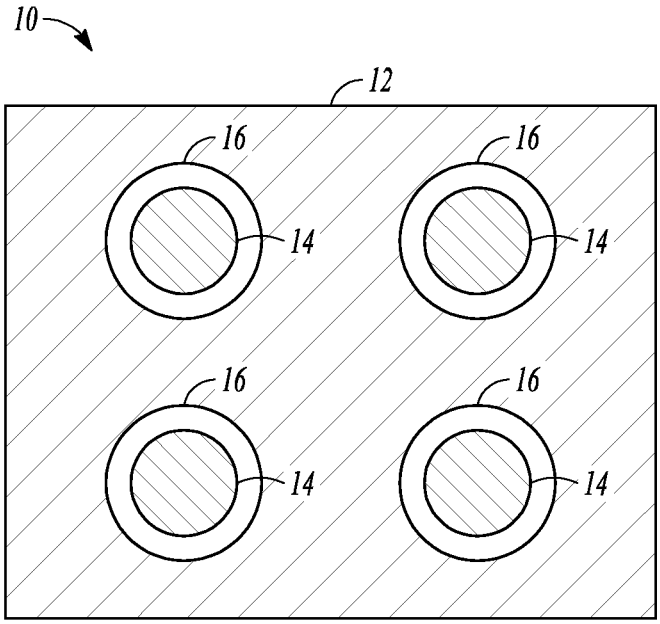
FIG. 1 is a schematic depiction of an alloy, in accordance with various embodiments of the disclosure.

As shown in FIG. 1, according to an embodiment of the present invention an alloy 10 includes elemental silver 12 and a metal oxide phase 14 dispersed within the elemental silver 12. The metal oxide phase 14 includes a wetting agent layer 16 that at least partially coats and encapsulates the metal oxide phase 14.

The metal oxide phase can take on many different forms. As a non-limiting example, the metal oxide phase can include individual metal oxide particles, globules, or fragments. The alloy can be well suited for high load switches (e.g. switches carrying more than 15 amps). where a silver cadmium oxide alloy can be used.

During operation of a high load switch, the alloy can be used as a contact surface. As the alloy is subjected to multiple make/break cycles, the elemental silver at the surface of the contact briefly melts and then re-solidifies upon cooling. This is due to the high temperature conditions of arc splash during a make/break event. During the arc splash event, the metal oxide helps to control the viscosity of the molten contact surface, while also serving as a heat sink that helps in cooling the contact surface as rapidly as possible. The choice of metal oxide is also inextricably linked to its alloying characteristics in how it impacts the conductivity of the silver metal oxide material and how it assists in anti-brazing properties of the alloy (which prevents the contact material from acting as a weld or solder material). For many metal oxides, the surface energy of the interface between silver and the metal oxide does not promote wetting, so when silver is molten, it tends to be repelled by the surface of the metal oxide and two domains begin to form, a silver-rich domain, and a metal oxide-rich domain. Once the metal oxide phase separates from the elemental silver it will not be able to mix with the elemental silver again. This is not desirable in a switch because metal oxides tend to be less conductive than elemental silver. Therefore, if the separated metal oxide phase abuts another contact of the switch it can be difficult to pass current through the contact. The wetting agent layer however helps to prevent total phase separation between the elemental silver and the metal oxide phase.

In short, if the placement of the wetting agent can be engineered according to this structural motif, it provides a continuous interface between the metal oxide phase and the elemental silver to maintain a substantially homogenous distribution therein. That is, the wetting agent layer that is used has a sufficiently low contact angle with elemental silver, which helps to ensure that the wetting agent layer is miscible with the elemental silver. This can help to ensure that complete phase separation between the elemental silver and the metal oxide phase is substantially prevented, or at least significantly delayed through multiple make/break cycles.

The individual components of the alloy can account for different weight percentages of the alloy. For example, the elemental silver can be about 80 wt % to about 98 wt %, or 88 wt % to about 96 wt %, less than, or equal to, or greater than about 80.5 wt %, 81.0, 81.5, 82.0, 82.5, 83.0, 83.5, 84.0, 84.5, 85.0, 85.5, 86.0, 86.5, 87.0, 87.5, 88.0, 88.5, 89.0, 89.5, 90.0, 90.5, 91.0, 91.5, 92.0, 92.5, 93.0, 93.5, 94.0, 94.5, 95.0, 95.5, 96.0, 96.5, or 97.5 wt % of the alloy. The metal oxide phase can be 4 wt % to about 12 wt %, or about 6 wt % to about 10 wt %, or less than, equal to, or greater than, about 6.5 wt %, 7.0, 7.5, 8.0, 8.5, 9.0, or 9.5 wt % of the alloy. The wetting agent layer can be about 0.05 wt % to about 1 wt %, or about 0.1 wt % to about 0.4 wt %, or less than, equal to, or greater than about 0.10 wt %, 0.15, 0.20, 0.25, 0.30, 0.35, 0.40, 0.45, 0.50, 0.55, 0.60, 0.65, 0.70, 0.75, 0.80, 0.85, 0.90, or 0.95 wt % of the alloy. The exact composition of each component is driven, in part, by the necessity to promote a precisely chosen coating thickness on the metal oxide particles, which is based on the metal oxide particle size distribution and volume/mass/density of the metal oxide.

The amount of the wetting agent in the alloy can be varied such that wetting agent layer is about 10 wt % to about 30 wt % or about 15 wt % to about 25 wt % or about 10.5 wt %, 11.0, 11.5, 12.0, 12.5, 13.0, 13.5, 14.0, 14.5, 15.0, 15.5, 16.0, 16.5, 17.0, 17.5, 18.0, 18.5, 19.5, 20.0, 20.5, 21.0, 21.5, 22.0, 22.5, 23.0, 23.5, 24.0, 24.5, 25.0, 25.5, 26.0, 26.5, 27.0, 27.5, 28.0, 28.5, 29.0, or 29.5 wt % of the encapsulated metal oxide phase.

Elemental Silver

Elemental silver is used in the alloy. Elemental silver has several properties that make it desirable for different applications. For example, elemental silver has good conductive properties, which makes it a desirable candidate to be used in alloys that are used as contacts in a switch. As described herein the elemental silver constitutes the bulk of the alloy. The elemental silver in the alloy can be an agglomeration of elemental silver atoms, fine particles, or globules.

Metal Oxide Phase

The metal oxide phase can include many different types of metal oxides. The metal oxide phase is homogenously dispersed within the alloy. The metal oxide phase can be one of many metal oxides. Non-limiting examples of suitable metal oxides include zinc oxide, tin oxide, tungsten oxide, copper oxide, copper peroxide, and iron oxide. The metal oxide phase can include one metal oxide so as to be free of other metal oxides. Alternatively, the metal oxide phase can include one or more metal oxides. Although many metal oxides can be used, the metal oxide phase described herein is free of cadmium oxide.

Cadmium oxide has been used in alloys deployed in switch contacts. While alloys such as those made from elemental silver and cadmium oxide perform well in high load switching applications, cadmium oxide is known to have potentially hazardous properties for the environment. The inventors have found, however, that forming an alloy from elemental silver and another metal oxide with a structurally engineered wetting agent applied to the interface between silver and metal oxide can achieve substantially equal performance in switches, while reducing or even substantially eliminating the hazardous properties as compared to silver cadmium oxide alloys.

The metal oxide phase can have many different shapes. For example the metal oxide phase can be formed from individual particles or globules having a generally spherical shape. Additionally, the metal oxide phase can be formed from individual particles or globules having a polygonal shape, or dendritic motif. In further examples the particles or globules of the metal oxide phase can have an elongated shape such as one generally resembling a fiber.

Generally, the elemental silver and the metal oxide phase are evenly distributed throughout the alloy to form a substantially homogenous distribution of the elemental silver and metal oxide phase. That is the alloy can be free of regions with disproportionate distributions of the elemental silver and the metal oxide phase. If the alloy is used in conjunction with a contact in a switch and is subsequently exposed to repeated make/break cycles the associated melting and resolidification can result in substantial phase separation and a heterogeneous distribution. However, because the metal oxide phase is coated by the wetting agent layer the homogenous distribution is substantially maintained through the cycles that the alloy is exposed to.

Wetting Agent

The metal oxide phase is at least partially coated by the wetting agent layer. That is the wetting agent layer can coat from 50% to 100% of the metal oxide phase surface area, or about 90% to about 100% of the metal oxide phase surface area, or less than about, equal to about, or greater than about 51%, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, or 99% of the metal oxide phase surface area. The thickness of the wetting agent layer can vary but the thickness can be low enough to be a considered a monolayer while still providing adequate coating to substantially prevent phase separation. The wetting agent forming the wetting agent layer can be one of many different compounds. In some embodiments of the invention, the wetting agent layer includes a single wetting agent and is free of other wetting agents. In other embodiments, the wetting agent layer includes one or more wetting agents. The wetting agent(s) can be about 50 wt % to about 100 wt %, or about 95 wt % to about 100 wt %, or less than, equal to, or greater than about 51 wt %, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, or 99 wt % of the wetting agent layer.

Non-limiting examples of suitable wetting agents to form the wetting agent layer include silver tungstate, copper oxide, molybdenum trioxide, tellurium dioxide, antimony trioxide, tantalum pentoxide, magnesium oxide, bismuth oxide, bismuth tin oxide, elemental bismuth, antimony trioxide, tantalum carbide, ruthenium oxide, germanium dioxide, tungsten oxide, or ruthenium oxide.

Each of the metal oxides of the metal oxide phase can be independently coated by the wetting agent layer. This creates an interface between metal oxide phase and the elemental silver that is adjacent thereto. This interface ensures that the elemental silver directly contacts the wetting agent layer of the metal oxide phase rather than the metal oxide phase itself. Therefore in the alloy, elemental silver is free of direct contact with the metal oxide phase.

Switch

Figure 2:
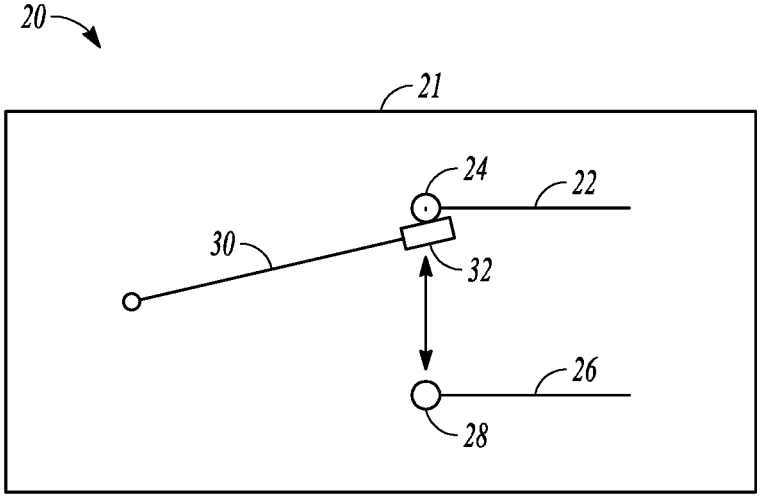
FIG. 2 is a schematic diagram of a switch including the alloy, in accordance with various embodiments of the disclosure.

A switch 20 is shown in FIG. 2. The switch is a device that can make, break, or change the connections in an electrical circuit. The mechanism of the switch can be disposed within housing 21 that can include a cover that is attached to the housing for the purpose of enclosing the mechanism.

According to various embodiments of the present invention, the switch can include a first stationary contact carrier 22. As illustrated the first stationary contact carrier is supported by the housing, although other configurations are contemplated. For example the first stationary contact could be supported in a cantilever manner, by a post. A first contact pad 24 is attached to the first stationary contact carrier. The first contact pad is rigidly attached to the first stationary contact carrier. The first contact pad includes a first alloy. The first alloy can be many different types of conductive alloys including a silver alloy. The first contact pad can be formed to take on many shapes such as rivet, or button, that is operatively associated with a hole formed in the first stationary contact carrier. Additionally, the first contact pad can be welded to first stationary contact carrier. In which case there is no need for a hole in the first stationary contact carrier. A second stationary contact carrier 26 is generally similar to that of the first stationary contact carrier. The secondary stationary contact carrier can include a second contact pad 28 formed from another conductive material such as a silver alloy.

The switch further includes a movable contact carrier 30 that is movable from a first position to a second position in the direction illustrated by the arrow in FIG. 2. A contact pad 32 is rigidly attached to the movable contact carrier 30 and is made of the silver metal oxide alloy 10 as described herein. In further embodiments, the silver metal oxide alloy can be disposed on either stationary contact.

The switch schematically depicted in FIG. 2 can be referred to as a single pole, double throw, single break design. Other switch designs are contemplated by this disclosure. Examples of further switch designs can include a single pole, single throw, single break design; a single pole, single throw, double break design; a single pole, double throw, double break design; a double pole, single throw, single break design; a double pole, single throw, double break design; a double pole, double throw, single break design; and a double pole, double throw, double break design.

Method of Making the Alloy

According to various embodiments of the present invention, a method of forming the silver metal oxide alloy includes coating a metal oxide phase with a wetting agent to form a coated metal oxide phase. The method further includes compacting the coated metal oxide phase with elemental silver, to form the silver metal oxide alloy.

The step of coating the metal oxide phase with the wetting agent can be accomplished in many different ways to make the desired engineered interface between the metal oxide and the silver. The coating the metal oxide phase is a preprocessing step that differs from merely adding a wetting agent dopant as a powder that is blended with all the other constituents to form an alloy.

One suitable method of coating the metal oxide phase includes a thermal-melt coating process. Using such a process, the alloy the choice of the wetting agent and the metal oxide phase is driven by the respective melting temperatures of each component. That is the wetting agent of the alloy is chosen to be one that has a melting temperature below the melting temperature of the metal oxide phase. One way of coating the metal oxide phase with the wetting agent layer is to blend the metal oxide phase with the wetting agent. The blending is carried out at a temperature that is higher than a melting temperature of the wetting agent but lower than a melting temperature of the metal oxide phase. This way molten wetting agent is applied to the solid metal oxide phase. This forms an intermediate mixture of liquid wetting agent and solid metal oxide phase. The intermediate mixture is then cooled to a temperature below the melting temperature of the wetting agent. This causes the wetting agent to solidify into a solid coating layer on the metal oxide phase. Once solidified, the wetting agent is the wetting agent layer.

Precipitation coating of the metal oxide phase with the wetting agent is another suitable coating method. To coat the metal oxide phase, the metal oxide is first exposed to an aqueous solution or slurry containing the wetting agent. This results in a salt containing the metal wetting agent to be deposited on the surface of the metal oxide phase. Subsequent heating decomposes the precipitating salt, which leaves behind the wetting agent on the surface of the metal oxide phase. In other variations, a sol-gel process can be used to initiate the precipitation and deposition process. In all of these method variations, a concentration gradient of precipitation agents, pH, temperature, or other precursor decomposition can be used to obtain a wetting agent as a coating on the metal oxide phase.

Spraying (spray drying or spray atomization) of a wetting agent in a molten, solution, or slurry form on to the metal oxide is another suitable method of achieving a coated metal oxide phase for formation of the desired interface between the metal oxide phase and the elemental silver components of the alloy.

Another suitable method of coating the metal oxide particles with the wetting agent includes growing the coating as a thin film from the vapor phase. In this method, the metal oxide phase is exposed to the vapors of the wetting agent under conditions that facilitate the deposition and/or growth of the wetting agent on the surface of the metal oxide. The method exploits the phase diagram and vapor pressure of the desired wetting agent such that the wetting agent is made volatile, and the volatile wetting agent is exposed to metal oxide particulate surface, where the vapor deposits to form a coating.

Additionally, electroplating a wetting agent on to the metal oxide phase is another way to coat the metal oxide for making the alloy.

Additionally, all of the methods described herein can be combined with post-treatments in a controlled gas environment to react and functionalize the wetting agent to increase the wetting agent's efficacy towards preventing phase separation.

After the metal oxide phase is coated, the resulting coated metal oxide phase is then powderized and combined with powderized elemental silver to produce a powder feedstock. The feedstock of coated metal oxide and elemental silver is mixed such that the combined mixture has a homogenous distribution of the coated metal oxide phase and the elemental silver. The mixed feedstock can then be placed in a die. Once the feedstock is placed in the die the feedstock is compacted under high pressure to form the alloy. The feedstock can be heated simultaneously during compaction to aide in forming the alloy.

EXAMPLE

Various embodiments of the present invention can be better understood by reference to the following Example which is offered by way of illustration. The present invention is not limited to the Example given herein.

In one example, the alloy includes elemental silver, which accounts for about 90 wt % to about 94 wt % of the alloy. The metal oxide phase includes tin oxide, which is about 6 wt % to about 10 wt % of the alloy. The wetting agent layer includes silver tungstate, which is coated on the tin oxide. The wetting agent layer is about 0.1 wt % to about 0.4 wt % of the alloy.

The terms and expressions that have been employed are used as terms of description and not of limitation, and there is no intention in the use of such terms and expressions of excluding any equivalents of the features shown and described or portions thereof, but it is recognized that various modifications are possible within the scope of the embodiments of the present invention. Thus, it should be understood that although the present invention has been specifically disclosed by specific embodiments and optional features, modification and variation of the concepts herein disclosed may be resorted to by those of ordinary skill in the art, and that such modifications and variations are considered to be within the scope of embodiments of the present invention.

Additional Embodiments

The following exemplary embodiments are provided, the numbering of which is not to be construed as designating levels of importance.

Embodiment 1 provides an alloy comprising:

elemental silver; and a metal oxide phase in the elemental silver, wherein the metal oxide phase comprises a wetting agent layer at least partially encapsulating the metal oxide phase.

Embodiment 2 provides the alloy according to Embodiment 1, wherein the elemental silver is about 80 wt % to about 98 wt % of the alloy.

Embodiment 3 provides the alloy according to any one of Embodiments 1-2, wherein the elemental silver is about 88 wt % to about 96 wt % of the alloy.

Embodiment 4 provides the alloy according to any one of Embodiments 1-3, wherein the metal oxide phase is about 4 wt % to about 12 wt % of the alloy.

Embodiment 5 provides the alloy according to any one of Embodiments 1-4, wherein the metal oxide phase is about 6 wt % to about 10 wt % of the alloy.

Embodiment 6 provides the alloy according to any one of Embodiments 1-5, wherein the wetting agent layer is about 0.05 wt % to about 1 wt % of the alloy.

Embodiment 7 provides the alloy according to any one of Embodiments 1-6, wherein the wetting agent layer is about 0.1 wt % to about 0.4 wt % of the alloy.

Embodiment 8 provides the alloy according to any one of Embodiments 1-7, wherein the wetting agent layer is about 10 wt % to about 30 wt % of the encapsulated metal oxide phase.

Embodiment 9 provides the alloy according to any one of Embodiments 1-8, wherein the wetting agent layer is about 15 wt % to about 25 wt % of the encapsulated metal oxide phase.

Embodiment 10 provides the alloy according to any one of Embodiments 1-9, wherein the metal oxide phase comprises zinc oxide, tin oxide, tin oxide, tungsten oxide, tungsten oxide, copper oxide, copper oxide, copper peroxide, copper oxide, iron oxide, or any combination thereof.

Embodiment 11 provides the alloy according to any one of Embodiments 1-10, wherein the metal oxide phase comprise one metal oxide and is free of other metal oxides.

Embodiment 12 provides the alloy according to any one of Embodiments 1-11, wherein the metal oxide phase comprise one or more metal oxides.

Embodiment 13 provides the alloy according to any one of Embodiments 1-12, wherein the metal oxide phase is free of cadmium oxide.

Embodiment 14 provides the alloy according to any one of Embodiments 1-13, wherein the wetting agent layer comprises a single wetting agent and is free of other wetting agents.

Embodiment 15 provides the alloy according to any one of Embodiments 1-14, wherein the wetting agent layer comprises one or more wetting agents.

Embodiment 16 provides the alloy according to any one of Embodiments 1-15, wherein the wetting agent layer comprises a wetting agent that is molybdenum trioxide, tellurium dioxide, antimony trioxide, tantalum pentoxide, magnesium oxide, bismuth oxide, bismuth tin oxide, elemental bismuth, antimony trioxide, tantalum carbide, ruthenium oxide, germanium dioxide, tungsten oxide, or ruthenium oxide.

Embodiment 17 provides the alloy according to any one of Embodiments 1-16, wherein the one or more wetting agents are about 50 wt % to about 100 wt % of the wetting agent layer.

Embodiment 18 provides the alloy according to any one of Embodiments 1-17, wherein the one of more wetting agents are about 95 wt % to about 100 wt % of the wetting agent layer.

Embodiment 19 provides the alloy according to any one of Embodiments 1-18, wherein the metal oxide phase comprise tin oxide and the wetting agent comprises silver tungstate.

Embodiment 20 provides the alloy according to any one of Embodiments 1-19, wherein the elemental silver is about 90 wt % to about 94 wt % of the alloy, the tin oxide is about 6 wt % to about 10 wt % of the alloy, and the silver tungstate is about 0.1 wt % to about 0.4 wt % of the alloy.

Embodiment 21 provides the alloy according to any one of Embodiments 1-20, wherein the wetting agent layer uniformly coats the metal oxide phase.

Embodiment 22 provides the alloy according to any one of Embodiments 1-21, wherein the wetting agent layer is a monolayer.

Embodiment 23 provides the alloy according to any one of Embodiments 1-22, wherein the elemental silver and the metal oxide phase are substantially homogenously distributed in the alloy.

Embodiment 24 provides the alloy according to any one of Embodiments 1-23, wherein the metal oxide phase has a substantially spherical shape.

Embodiment 25 provides the alloy according to any one of Embodiments 1-24, wherein each of the metal oxides of the metal oxide phase is independently encapsulated by the wetting agent layer.

Embodiment 26 provides the alloy according to any one of Embodiments 1-25, wherein the wetting agent layer defines an interface between metal oxide phase and the elemental silver that is adjacent thereto.

Embodiment 27 provides the alloy according to any one of Embodiments 1-26, wherein the elemental silver directly contacts the wetting agent layer of the metal oxide phase.

Embodiment 28 provides the alloy according to any one of Embodiments 1-27, wherein the elemental silver is free of direct contact with the metal oxide phase.

Embodiment 29 provides method of forming the alloy according to any one of Embodiments 1-28 comprising:

coating a metal oxide phase with a wetting agent to form a coated metal oxide phase; and compacting the coated metal oxide phase with elemental silver, to form the alloy according to any one of Embodiments 1.

Embodiment 30 provides the method according to any one of Embodiments 29, wherein the wetting agent of the alloy has a melting temperature below the melting temperature of the metal oxide phase.

Embodiment 31 provides the method according to any one of Embodiments 29-30, wherein coating the metal oxide phase with the wetting agent comprises blending the metal oxide phase with the wetting agent at a temperature that is higher than a melting temperature of the wetting agent and lower than a melting temperature of the metal oxide phase to form an intermediate mixture of liquid wetting agent and solid metal oxide phase.

Embodiment 32 provides the method according to any one of Embodiments 29-31, wherein coating the metal oxide phase with the wetting agent further comprises:

cooling the intermediate mixture a to a temperature below the melting temperature of the wetting agent to solidify the wetting agent into a solid coating layer on the metal oxide phase that is the wetting agent layer.

Embodiment 33 provides a switch comprising:

a first stationary contact carrier;

a first contact pad attached to the first stationary contact carrier and comprising a first alloy;

a movable contact carrier; and a second contact pad attached the movable contact carrier, wherein the second contact pad comprises the alloy according to any one of Embodiments 1-28 and is configured to selectively engage the first contact pad.

Embodiment 34 provides the switch according to any one of Embodiments 32-33, and further comprising:

a second stationary contact carrier;

a third contact pad attached the second stationary contact carrier and comprising a second alloy.

Embodiment 35 provides a method of making a switch comprising:

attaching a first contact pad comprising a first alloy to a first stationary contact carrier; and attaching a second contact pad to a movable carrier, wherein the second contact pad comprises the alloy according to any one of Embodiments 1-28.

Embodiment 36 provides the method according to Embodiment 35, and further comprising attaching a third contact pad comprising a second alloy to a second stationary contact carrier.

What is claimed is:

1. An alloy comprising:

elemental silver; and a metal oxide phase in the elemental silver, wherein the metal oxide phase comprises a wetting agent layer, wherein the wetting agent layer defines an interface between the metal oxide phase and the elemental silver that is adjacent thereto.

2. The alloy of claim 1, wherein the wetting agent layer encapsulates and uniformly coats the metal oxide phase.

3. The alloy of claim 1, wherein the elemental silver is about 80 wt % to about 98 wt % of the alloy.

4. The alloy of claim 1, wherein the metal oxide phase is about 4 wt % to about 12 wt % of the alloy.

5. The alloy of claim 1, wherein the wetting agent layer is about 0.05 wt % to about 1 wt % of the alloy.

6. The alloy of claim 1, wherein the metal oxide phase comprises zinc oxide, tin oxide, tungsten oxide, copper oxide, copper peroxide, iron oxide, or any combination thereof.

7. The alloy of claim 1, wherein the metal oxide phase comprises one metal oxide and is free of other metal oxides.

8. The alloy of claim 1, wherein the metal oxide phase is free of cadmium oxide.

9. The alloy of claim 1, wherein the wetting agent layer comprises a wetting agent that is molybdenum trioxide, tellurium dioxide, antimony trioxide, tantalum pentoxide, magnesium oxide, bismuth oxide, bismuth tin oxide, elemental bismuth, tantalum carbide, germanium dioxide, tungsten oxide, or ruthenium oxide.

10. The alloy of claim 1, wherein the metal oxide phase comprises tin oxide and the wetting agent comprises silver tungstate.

11. The alloy of claim 1, wherein the elemental silver and the metal oxide phase are substantially homogenously distributed in the alloy.

12. The alloy of claim 1, wherein the elemental silver directly contacts the wetting agent layer of the metal oxide phase.

13. The alloy of claim 1, wherein the elemental silver is free of direct contact with the metal oxide phase.

14. A switch comprising:

a first stationary contact carrier;

a first contact pad attached to the first stationary contact carrier and comprising a first alloy;

a movable contact carrier; and a second contact pad attached to the movable contact carrier, wherein the second contact pad is configured to selectively engage the first contact pad and is formed from an alloy comprising:

elemental silver; and a metal oxide phase in the elemental silver, wherein the metal oxide phase comprises a wetting agent layer and the wetting agent layer defines an interface between the metal oxide phase and the elemental silver that is adjacent thereto.

15. The switch of claim 14, further comprising:

a second stationary contact carrier; and a third contact pad attached to the second stationary contact carrier and comprising a second alloy.

16. A method of forming an alloy, the method comprising:

coating a metal oxide phase with a wetting agent to form a coated metal oxide phase comprising a wetting agent layer; and compacting the coated metal oxide phase with elemental silver, wherein the wetting agent layer defines an interface between the metal oxide phase and the elemental silver that is adjacent thereto.

17. The method of claim 16, wherein the wetting agent of the alloy has a melting temperature below the melting temperature of the metal oxide phase.

18. The method of claim 16, wherein coating the metal oxide phase with the wetting agent comprises blending the metal oxide phase with the wetting agent at a temperature that is higher than a melting temperature of the wetting agent and lower than a melting temperature of the metal oxide phase to form an intermediate mixture of liquid wetting agent and solid metal oxide phase.

19. The method of claim 18, wherein coating the metal oxide phase with the wetting agent further comprises:

cooling the intermediate mixture to a temperature below the melting temperature of the wetting agent to solidify the wetting agent into a solid coating layer on the metal oxide phase that is the wetting agent layer.

20. The method of claim 16, wherein coating the metal oxide phase with the wetting agent comprises: solution deposition of the wetting agent on the metal oxide phase, thermal-melt coating the metal oxide phase with the wetting agent, spray coating the metal oxide phase with the wetting agent, vapor phase deposition of the wetting agent on the metal oxide phase, electroplating the wetting agent on the metal oxide phase, or combinations thereof.

* * * * *